United States Patent [19]

Dunn

[11] Patent Number: 4,891,020

[45] Date of Patent: Jan. 2, 1990

[54] LOW PROFILE METAL SHELL ELECTRICAL CONNECTOR

[75] Inventor: James S. Dunn, Doylestown, Pa.

[73] Assignee: Thomas & Betts Corporation, Bridgewater, N.J.

[21] Appl. No.: 174,259

[22] Filed: Mar. 28, 1988

[51] Int. Cl.[4] ..... H01R 4/24

[52] U.S. Cl. ..... 439/405; 439/741; 439/717; 439/901

[58] Field of Search ..... 439/389, 413, 417, 418, 439/350–352, 901–906, 607–610, 717, 741, 751

[56] References Cited

U.S. PATENT DOCUMENTS

| | | | |
|---|---|---|---|
| 3,990,767 | 11/1976 | Narozny | 339/198 |
| 4,006,957 | 2/1977 | Narozny | 439/405 |
| 4,160,574 | 7/1979 | DeRoss | 439/405 |
| 4,241,970 | 12/1980 | Rider, Jr. et al. | 339/99 |
| 4,359,257 | 11/1982 | Lopinski et al. | 339/99 |
| 4,381,132 | 4/1983 | Tournier | 339/99 |
| 4,412,714 | 11/1983 | Morningstar et al. | 439/352 |
| 4,431,248 | 2/1984 | Huntley et al. | 339/99 |
| 4,470,655 | 9/1984 | Kalka et al. | 339/99 |
| 4,484,791 | 11/1984 | Johnson | 339/99 |
| 4,512,618 | 4/1985 | Kumar | 439/95 |
| 4,537,458 | 8/1985 | Worth | 339/143 |
| 4,538,873 | 9/1985 | Worth | 339/99 |
| 4,556,272 | 12/1985 | Briones | 339/99 |
| 4,560,226 | 12/1985 | Dennis | 339/99 |
| 4,603,475 | 8/1986 | Schützle | 29/857 |
| 4,643,509 | 2/1987 | Hollyday et al. | 439/607 |
| 4,659,163 | 4/1987 | Althouse et al. | 439/608 |
| 4,701,139 | 10/1987 | Good et al. | 439/607 |
| 4,703,990 | 11/1987 | Assmann et al. | 439/404 |
| 4,789,357 | 12/1988 | Yamaguchi et al. | 439/607 |

OTHER PUBLICATIONS

Thomas & Betts, Electronics Division, "Mass Termination IDC System" Cat. No. IDC-3, 1987, Front cover, back cover, pages 50–52, 64–70.

3M data sheet, "D-Sub, News Scotchflex® Stecker system mit grober typenvielfalt", undated.

*Primary Examiner*—David Pirlot

*Attorney, Agent, or Firm*—Robert M. Rodrick; Salvatore J. Abbruzzese

[57] ABSTRACT

A low profile, metal shell insulation displacement contact (IDC) connector comprises an elongate insulative housing having two spaced longitudinally extending sidewalls and two transversely extending longitudinally spaced end walls. Within the interior of the housing sidewalls, there are a plurality of pockets formed therein for securing a metal shell to the housing. The metal shell is preferably made in two-part construction wherein a lower portion defining a continuous D-shaped configuration is attached by deformable tabs to an upper portion and the upper portion comprises a plurality of deformably prongs that are adapted to be received in the pockets of the housing and deformed therein for securing the composite metal shell thereto. A cover is latchably secured to the end walls of the housing and a strain relief is provided for sandwiching a flat multiconductor ribbon cable between the strain relief and the cover. The strain relief is particularly configured to be lockingly attached to the sidewalls of the connector housing in a manner allowing the length of the connector to be maintained at a minimum dimension.

6 Claims, 5 Drawing Sheets

FIG. 8
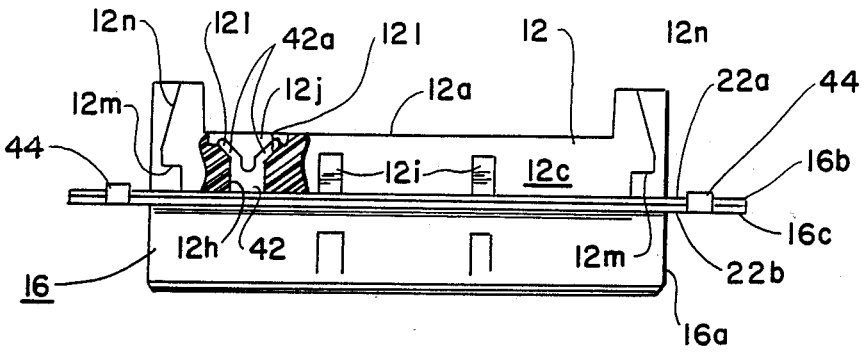
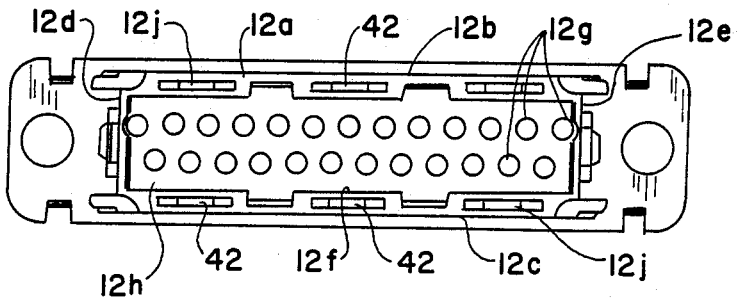
FIG. 9

LOW PROFILE METAL SHELL ELECTRICAL CONNECTOR

FIELD OF THE INVENTION

The present invention relates to an electrical connector and, more particularly, to an electrical connector of the insulation displacement contact type protected by a metal shell and specifically constructed to have a low profile configuration.

BACKGROUND OF THE INVENTION

Electrical connectors of the type for mass termination to flat multiconductor ribbon cable have been in use particularly in the data communications industry for some time. Such mass termination electrical connectors typically include insulation displacement contacts (IDC) by which conductors contained in a flat multiconductor ribbon cable are commonly terminated without need for stripping the conductors from the insulation. One example of such a connector is U.S. Pat. No. 3,990,767 (Narozny), wherein all the contacts are formed initially to have an identical configuration for manufacturing purposes and which are later bent during assembly to achieve a pitch transition. In the Narzony connector, electrical interconnection is made from a flat multiconductor cable wherein conductors are spaced at 0.050 inch to a standard D-face configuration wherein the pins or sockets are located at 0.0545 inch.

Demands in the communications industry have been placed upon the electrical connector manufacturers for adding protection against electromagnetic and radio frequency interference (EMI/RFI), smaller sizes in an effort to conform to higher density packaging and lower manufacturing costs. One example of an electrical connector having insulation displacement contacts, as well as a metal shell for electrical protection is U.S. Pat. No. 4,470,655 (Kalka, et al.). As in the Narozny patent, the Kalka, et al. device achieves pitch transition by the use of identical contact elements having a central deformable strap portion that is bent to achieve the desired pitch transition. In another example of an electrical connector of the IDC type, albeit without a metal shell, U.S. Pat. No. 4,241,970 (Rider, Jr., et al.) discloses an electrical connector having IDC contacts that are formed during manufacture to have the desired pitch transition which is stated to result in a design with a lower profile and economy of manufacture.

In keeping with the trend in the communications industry, it is desirable to provide an electrical connector having IDS's for mass termination and which includes a metal shell for electrical protection and is constructed considering the overall size limitations needed by the industry.

SUMMARY OF THE INVENTION

It is a primary object of the present invention to provide an improved electrical connector having insulation displacement contacts.

It is a further object of the present invention to provide such an electrical connector with a metal shell for electrical protection and configured in a manner to allow for reduction in the connector profile.

In accordance with a preferred form of the invention, an electrical connector of the type having an insulative housing supporting a plurality of insulation displacement contacts for electrical engagement to insulated conductors is provided with a metal shell secured to the housing, a portion of the metal shell surrounding the contacts. The electrical connector includes improved securement means which is provided interiorly of the housing and which holds the metal shell fixed thereto. The metal shell includes thereon at least one locking member having an extent projecting interiorly into the housing and cooperating with the securement means to fixedly hold the metal shell onto the housing.

In a further form of the invention, and in consideration of the size of the connector, a strain relief is provided which is secured to the connector housing at the side surfaces rather than the end walls so as to allow a smaller size configuration of the connector.

BRIEF DESCRIPTION OF THE DRAWINGS

FIG. 7(*b*) is a cross-sectional view as seen along viewing lines VII—VII of FIG. 7(*a*).

FIG. 7(*c*) is a view of FIG. 7(*a*) shown subsequent to the removal of the carrier webs.

FIG. 7(*d*) is a view of FIG. 7(*c*) showing in phantom the disposition and support of a flat multiconductor ribbon cable on the insert subassembly subsequent to mass termination to the contacts.

FIG. 8 is a front elevation view partially fragmented to show interior details therein of the securement of the metal shell to the insulative housing.

FIG. 9 is a top plan view of FIG. 8.

DETAILED DESCRIPTION OF THE PREFERRED EMBODIMENTS

Figure 1:
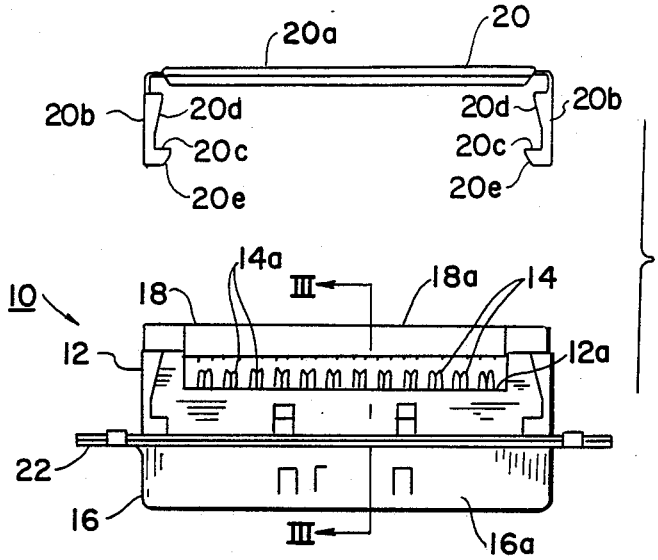
FIG. 1 is an exploded side elavation view of a preferred form of the subject invention which is a metal shell transition 'D' connector having insulation displacement contacts for mass termination to conductors of a flat multiconductor ribbon cable, a cable strain relief being shown in a disassembled state.
Figure 2:
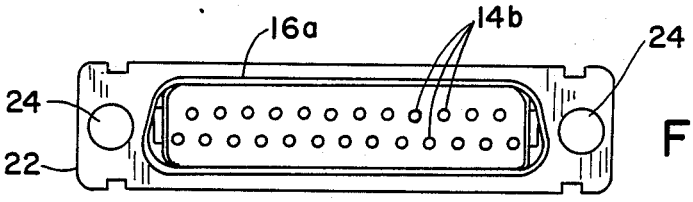
FIG. 2 is a bottom plan view of the connector of FIG. 1 particularly showing the industrial standard D-shape formed by the metal shell.
Figure 3:
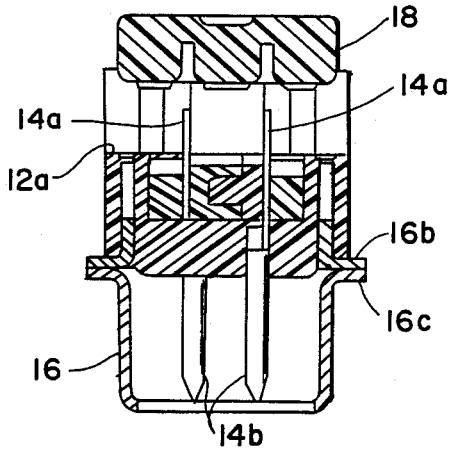
FIG. 3 is an enlarged cross-sectional view of a portion of the electrical connector as seen along viewing lines III—III of FIG. 1.

Turning now to the drawing figures, in particular FIGS. 1, 2, and 3, a metal shell, pitch transition electrical connector 10 in accordance with a preferred embodiment of the invention is shown. The connector 10 comprises an elongate insulative housing 12 supporting a plurality of insulation displacement contacts (IDC) 14, a metal shell 16 secured to the housing 12, an insulative cover 18 movably attached to the housing 12 and overlying the contacts 14 and a strain relief 20 attachable to the housing 12 and adapted to overlie the cover 18. In the preferred embodiment illustrated, the electrical connector 10 supports twenty-five (25) insulation displacement contacts 14 in two parallel rows, one row comprising thirteen (13) contacts and the other row comprising twelve (12) contacts, as seen in FIG. 2. It should be appreciated, however, that other rows and numbers of contacts may also be used in the contemplated scope of the invention.

Referring still to FIGS. 1 and 2, the contacts 14 in the subject invention have insulation displacement contact ends 14*a* that are positioned in the connector housing 12 to be mass terminated to conductors of a flat, multiconductor ribbon cable (not shown), wherein the conductors are spaced apart at 0.050 inch. The contacts 14 have electrical terminals 14*b* in the form of pins as shown in FIGS. 2 and 3, although socket terminals may also be used, that are positioned in the housing to be intermateable with terminals of an external connector (not shown) that are spaced at 0.0545 inch. As depicted, the IDC ends 14*a* project in an exposed manner upwardly from an upper surface 12*a* of the housing 12 so as to be accessible for mass termination to conductors of a flat multiconductor cable.

The metal shell 16 is spaced downwardly from the IDC ends 14*a* and is supported on the housing 12 adjacent the bottom portion of the connector 10. The metal shell 16 includes a flange 22 extending lengthwise along the connector 10 and projects transversely outwardly from the housing 12. The flange 22 has a pair of mounting apertures 24 located longitudinally externally of the housing 12 for attachment to a suitable panel or the like. The metal shell 16 includes at its lower portion a continuous wall portion 16*a* that surrounds the contacts 14 at the pin ends 14*b* and that, as seen in FIG. 2, defines the industry standard D-shape configuration for polarized attachment to a mateable electrical connector. It should be understood herein that the use of the terms "upper" and "lower" are intended as an aid in describing the preferred embodiment for relative directionality and is not intended to limit the invention being described.

Figure 4:
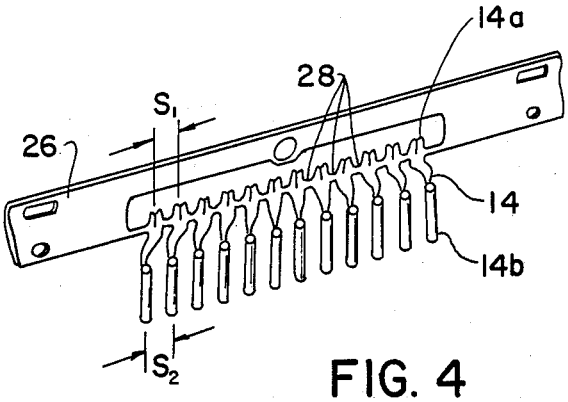
FIG. 4 is a perspective view of an array of insulation displacement contacts formed in accordance with a preferred form of the invention to the desired pitch transition and shown in an interim state wherein the contacts are interconnected on a carrier strip.

Turning now to FIGS. 4, 5, 6 and 7(*a*)–7(*d*), further details of the subject connector are more fully described. In FIG. 4, there is shown an array of twelve (12) contacts 14 as seen during an interim stage of manufacture and which will form one of the rows of contacts 14 in the connector 10. As illustrated, the contacts 14 are stamped in accordance with conventionally known techniques to have the preferred pitch transition. As such, the contacts 14 are stamped in a linear array such that the contact ends 14*a* have a spacing $S_1$ between adjacent ends 14*a* that differs from the spacing $S_2$ extending between adjacent pin ends 14*b*. In the preferred arrangement, the spacing $S_1$ is 0.100 inch while the spacig $S_2$ is 0.109 inch. The contacts 14 during this stage of construction, are supported on a main carrier strip 26 and the IDC ends 14*a* are each interconnected therebetween by a carrier web 28.

Figure 5:
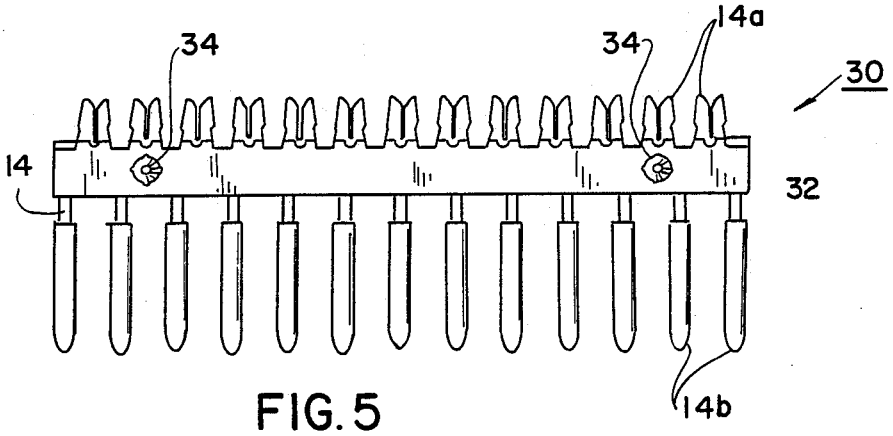
FIG. 5 is a front elevation view of one molded insert subassembly wherein the contacts of FIG. 4 have been separated into individual contacts and supported in an insulative insert.
Figure 6:
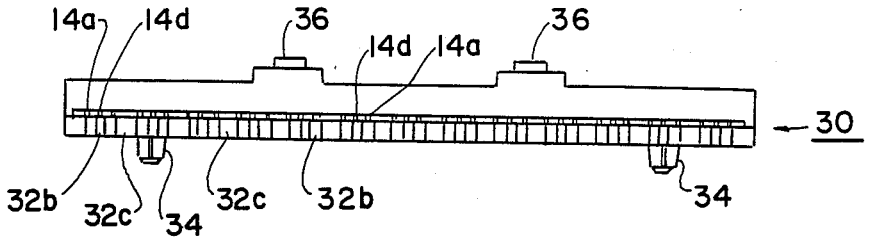
FIG. 6 is a top plan view of the molded insert subassembly of FIG. 5.

Referring now to FIGS. 5 and 6, a molded insert subassembly 30 comprising an array of contacts formed in accordance with the construction of FIG. 4 is shown. In the subassembly 30 illustrated, the contacts 14 are supported and fully surrounded by an insulative insert 32 that, in accordance with the preferred arrangement of the invention, is injection molded therearound in a suitable manner. The insert 32 is formed to be elongate and support the contacts 14 longitudinally therealong. Formed integrally with the insert 32, the purposes of which will be described hereinafter, are outwardly directed projections 34 and latches 36. In the subassembly 30 the carrier webs 28 (FIG. 4) have been removed resulting thereby in a construction wherein the contacts 14 are independent of, and insulated from, each other along the length of the insert 32. By reference now to FIG. 7(*a*) through FIG. 7(*d*), the manner in which the subassembly 30 is achieved is more fully described.

In FIG. 7(*a*), there is shown a stage of construction wherein the insert 32 has been molded around the contacts 14 and wherein the contacts 14 are still interconnected by the carrier webs 28. The insert 32 is formed around the contacts 14 in a manner wherein the contact ends 14*a* project upwardly above an upper surface 32*a* of the insulative insert 32. Each IDC end 14*a* comprises a pair of pointed, insulation piercing tines 14*c* which define therebetween a slot 14*d* for receiving in electrical engagement therein a conductor of the flat multiconductor ribbon cable to which the contacts 14 are to be interconnected. The carrier webs 28 interconnect the tines 14*c* therebetween, each web 28 extending longtiduinally along the insert 32 and substantially parallel to the upper surface 32*a*.

Still referring to FIG. 7(*a*), the insert 32 is formed to have a recess 32*b* extending downwardly into the upper surface 32*a*, each recess 32*b* being in longitudinal alignment with a respective IDC slot 14*d*. The insert 32 is also formed around the contacts 14 such that the IDC slot 14*d* of each contact extends downwardly toward each recess 32*b* and such that the bottom of the slot 14*d* is downwardly spaced below surface 32*a* a distance $S_3$ as illustrated in FIG. 7(*a*). In the preferred arrangement, the distance $S_3$ is formed to be approximately 0.005 inch.

Referring now to FIG. 7(*a*) and also FIG. 7(*b*), the insert 32 is further formed to have a plurality of grooves 32*c* extending transversely into upper surface substantial registry with each of the carrier webs 28. In the preferred embodiment, each carrier web 28 has an upper edge 28*a* and a lower edge 28*b*. Edge 28*b* of each carrier web 28 lies in a plane substantially coincident with the upper surface 32*a*, each edge 28*b* being spaced above the bottom wall of each groove 32*c*. During the molding operation of the insert 32 around the contacts 14, there is formed as seen in FIG. 7(*b*), a film 32*d* of insulative material formed integrally with the insert 32. Film 32*d* lies between the bottom edge 28*b* of each carrier web 28 and the bottom surface of each groove 32*c*. The thickness of the film 32*d* is substantially the same as the thickness, t, of the IDC end 14*a*, as depicted in FIG. 7(*b*), the thickness, t, in the preferred embodiment being 0.012 inch.

Referring now to FIG. 7(*c*), a stage of the insert subassembly is shown wherein the carrier webs 28 have been removed. To effect removal of the carrier webs 28, a suitable tool (not shown) is used to sever the carrier webs 28 from the attached tines 14c of the contacts. During web removal, the severing tool is passed between adjacent tines 14c of each contact and within each groove 32c. The severing tool, upon removal of the carrier webs 28, further forms a cutout portion 14e in each tine 14c adjacent a groove 32c and further removes a portion of the film 32d of the insert 32. While a small portion of the film 32d in each groove 32c is removed with the removal of the carrier webs 28, the provision of the grooves 32c in registry therewith reduces the need to remove a thicker amount of insulation from the insert 32, thereby advantageously minimizing the wear on the web severing tool.

Figure 7A:
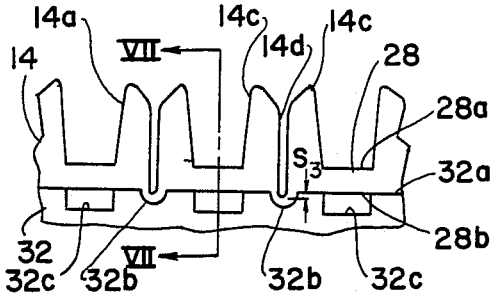
FIG. 7(*a*) is an enlarged view of a portion of the contacts of FIG. 4 shown during an interim stage of manufacture wherein the insulative insert has been molded around the contacts and the carrier webs interconnecting the contacts are still in place.
Figure 7B:
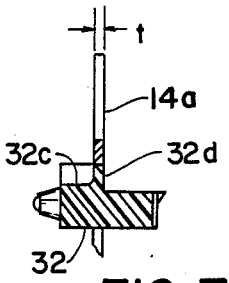
Figure 7C:
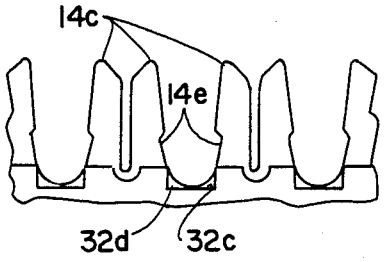
Figure 7D:
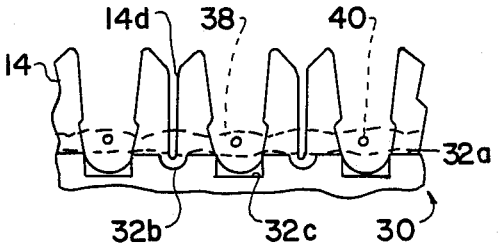

By reference now to FIG. 7(d), the benefits of the construction of the molded insert subassembly 30 can be appreciated. A flat multiconductor ribbon cable 38 is shown in phantom in an interconnected manner with the contacts 14 of the subassembly 30. A plurality of conductors 40 are contained in the insulation of the cable 38. Upon being interconnected to the contacts 14, the cable rests on upper surface 32a which provides thereby a cable support surface. The cable conductors 40 respectively reside in the slots 14d of the contacts 14 and the cable is supported by surface 32 on both sides of the recess 32b. This support coupled with the construction of the slot 14d extending below the support surface 32a, provides for interconnection of the cable conductors 40 in the slots 14d without the conductors 40 striking the bottoms of the slots 14d. As such, inadvertent nicking or severing of the conductors during interconnection to the contacts 14 is prevented.

Turning now to FIGS. 8 and 9 and also with further reference to FIG. 3, the details of the securement of the metal shell to the connector housing are more fully described. The connector housing 12 is formed generally elongate having a pair of transversely spaced sidewalls 12b and 12c and a pair of longitudinally spaced end walls 12d and 12e. The sidewalls and end walls of the housing 12 form therebetween a cavity 12f for receipt of the molded insert subassemblies as will be described hereinbelow. The sidewalls 12b and 12c further define upper surface 12a of the housing from which the insulation displacement contacts 14 project for electrical interconnection with conductors of a flat multiconductor ribbon cable. A plurality of apertures 12g extend through a bottom wall 12h of the housing, each aperture 12g communicating with the cavity 12f and being positioned to receive therein a contact pin end 14b of each contact 14. Extending transversely through each of the sidewalls 12b and 12c are latching openings 12i adapted to latchingly engage the latches 36 of the insert subassemblies as will be described.

Extending longitudinally in each sidewalls 12b and 12c are three pockets 12j, the upper portion of each pocket 12j extending through surface 12a and being of greater dimension than an opening 12k defining the lower portion of each pocket 12j. Each pocket 12j is further defined by a pair of spaced obliquely inclined interior surfaces 12L which provide cooperating locking surfaces for securement of the metal shell 16 as will be described.

The metal shell 16, as seen particularly in FIGS. 8 and 3, is constructed in accordance with the preferred arrangement of the invention in two portions, a top portion 16b and a bottom portion 16c. Top portion 16b includes a horizontally extending flange portion 22a and integrally thereon and projecting upwardly therefrom six locking elements 42 arranged in two substantially parallel, transversely spaced rows. Each locking element 42 is positioned to be in registry with a pocket 12j of the housing 12. Each locking element 42 includes a pair of spaced deformable prongs 42a. The locking elements 42 are adapted to be received in the respective openings 12k of the housing pockets and with suitable tooling (not shown) that access the locking elements in the pockets through the upper housing surface 12a, the prongs 42a are respectively deformed outwardly against inclined surfaces 12L such that the prongs are spaced dimensionally greater than the opening 12k to thereby lock the locking elements and the top metal portion 16b fixedly to the housing 12.

Referring still to FIG. 8, bottom metal shell portion 16c comprises the wall portion 16a defining the D-shape configuration, bottom portion 16c further including a flange portion 22b extending longitudinally and from which the wall portion 16a projects downwardly therefrom. Bottom portion 16c further includes integrally thereon a plurality of deformable tabs 44 that project upwardly from the flange portion 22b and which tabs 44 are adapted to engage the upper flange portion 22a to thereby mechanically secure the metal shell top portion 16b and metal shell bottom portion 16c in secured relation. As so joined, the flange portions 22a and 22b define the connector flange 22 as illustrated in FIG. 1.

It should be appreciated that by the use of the locking element 42 and interior pockets 12j whereby the metal shell 16 is secured internally of the housing 12, the need for external housing support structure is minimized thereby permitting a reduction in the size of the subject connector.

Turning now to FIGS. 1 and 8, the details of the strain relief of the present invention are described. The strain relief 20 in the preferred construction is formed of metal, for example, stainless steel and includes a substantially planar, elongate portion 22a that is adapted to overlie the cover 18 of the subject connector. Depending downwardly therefrom at the longitudinal ends of the strain relief 20, there are locking legs 20b. Each leg 20b includes a locking portion defined by the longitudinally extending surface 20c and an inclined surface 20d. At the lower extent of each locking portion 20b, there is a chamfered surface 20e that is formed at an oblique angle relative to the longitudinal direction of the surface 20c.

Within the front surface of each outer side wall 12b and 12c as illustrated in FIG. 8, there are formed adjacent the end walls 12d and 12e, cooperative locking portions for engagement with the legs 20b of the strain relief 20. The housing locking portions are defined by a longitudinally extending surface 12m and an inclined surface 12 n formed into the housing sidewalls in a configuration complementary to the locking surfaces in the strain relief legs 20b. In assembling the strain relief to the housing 12, the chamfered surfaces 20e engage the inclined surfaces 12n of the housing initially causing the legs 20b to longitudinally flex outwardly during assembly. The strain relief 20 is then further moved downwardly onto the housing until the longitudinal surfaces 20c of each leg 20b snap into engagement with the longitudinal surfaces 12m on the housing to thereby lock the strain relief thereon. Construction of the strain relief and the locking portions of the housing to be on the side exterior surfaces permits the connector to be constructed to a minimal longitudinal dimension as desired.

Figure 10:
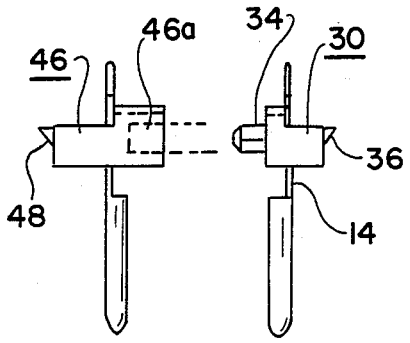
FIG. 10 is an exploded side elevation view showing the molded insert subassembly of FIG. 5 ready for joining to a second molded insert subassembly formed in a similar manner.
Figure 11:
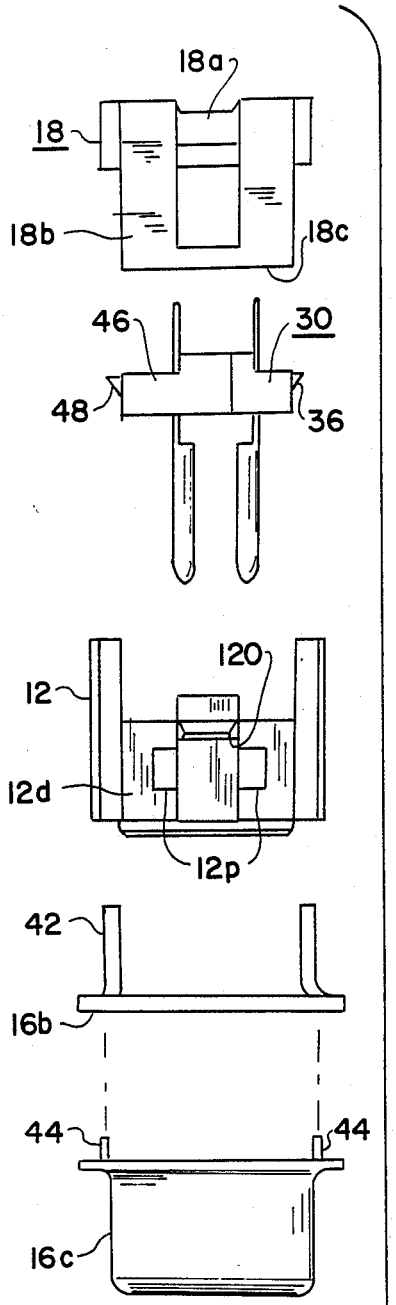
FIG. 11 is an exploded side elevation view showing schematically the various components of the electrical connector of the preferred embodiment of the invention and the assembly process.

Turning now to FIGS. 10 and 11, the assembly of the preferred embodiment of the subject electrical connector is set forth. The metal shell bottom portion 16c is attached to the metal shell top portion 16b by the deformable tabs 44. The composite shell portions fixedly secured are then secured to the housing 12 by the locking elements 42 being internally attached to the housing 12 as previously described. By reference specifically to FIG. 10, the molded insert subassembly 30 is joined to a similarly formed molded insert subassembly 46. While subassembly 30 supports a row of thirteen (13) contacts, subassembly 46 supports a row of twelve (12) contacts. The subassembly 46 further includes a plurality of spaced sockets 46a that are particularly configured to receive the projections 34 of subassembly 30. Similar to subassembly 30, subassembly 46 also includes latches 48 projecting outwardly therefrom. The joined subassemblies 30 and 46, as illustrated in FIG. 11, are then together inserted into the cavity 12f of the housing 12 and the latches 36 and 48 are suitably engaged in the openings 12i in the sidewalls 12b and 12c respectively of the housing 12, thereby securing the subassemblies 30 and 46 relative to the housing 12. The elongate connector cover 18, which has a longitudinally extending portion 18a and two downwardly spaced depending legs 18b at the longitudinal ends thereof, is secured to the housing end walls 12d and 12e by a horizontally extending latching member 18c that engages a first latch 12o provided on the respective end walls 12d and 12e. In this position, the cover is in a precrimped condition which is depicted in FIG. 1 whereby a flat multiconductor ribbon cable may be inserted between the planar cover portion 18a and the insulation displacement contacts preliminary to mass termination. The housing further includes on its end walls 12d and 12e a second latch defined by ledges 12p that engage the cover latching member 18c subsequent to moving the cover downwardly against a flat multiconductor ribbon cable to effect mass termination. In this crimped position, the cover 18 is thus locked relative to the housing by the ledges 12p. Following mass termination of a flat multiconductor ribbon cable in this manner, the cable is typically folded back over the connector such that the outer insulation of the cable resides on the top surface of the cover 18. The strain relief is then attached to the housing in a manner described hereinabove such that the flat multiconductor cable is pressed between the planar portion 20a of the strain relief and the planar portion 18a of the connector cover 18. So assembled, the height of the connector from the bottom of the metal shell portion 16a to the top of the strain relief is on the order of 0.73 inch.

Having described the preferred embodiments of the invention herein, it should be appreciated that variations may be made thereto without departing from the contemplated scope of the invention. Accordingly, the preferred embodiment is intended to be illustrative rather than limiting. The true scope of the invention is set forth in the claims appended hereto.

What is claimed is:

1. In an electrical connector of the type having an insulative housing supporting a plurality of insulation displacement contacts for electrical engagement to insulated conductors and a metal shell secured to said housing, a portion of said metal shell surrounding said contacts, the improvement wherein:

said housing is elongate and includes two transversely spaced side walls, two longitudinally spaced end walls and an upper surface from which insulation displacement ends of said contacts project, said housing including interiorly thereof securement means holding said metal shell fixed thereto; wherein said metal shell comprises a substantially planar longitudinally extending flange, said flange being disposed generally parallel to and spaced from said upper surface, said metal shell including thereon at least one locking member having an extent projecting interiorly into said housing and cooperating with said securement means to fixedly hold said metal shell onto said housing, and wherein said securement means comprises a pocket located adjacent one of said side walls of said housing and interiorly thereof, said pocket being defined by an interior surface engaging said locking member, said locking member including a deformable projection extending from said flange upwardly into said pocket into deformed relation with said interior surface of said pocket, said deformable projection comprising two bendable, spaced prongs and wherein said pocket has an interior surface adjacent each prong and in engagement therewith, said pocket defining an opening receiving said projection, said opening extending through said upper surface of said housing for access to said projection, said interior surface adjacent each prong being disposed at an obliquie angle relative to said opening, wherein deformation of said prongs against such oblique surfaces causes said prongs to be in a position dimensionally greater than said opening.

2. An electrical connector according to claim 1, wherein there are a plurality of such projections and pockets extending longitudinally along both side walls of said housing.

3. An electrical connector according to claim 1, wherein said metal shell comprises a first shell portion and a second shell portion secured together by joining means.

4. An electrical connector according to claim 3, wherein said first shell portion defines a portion of said flange and includes said projections thereon.

5. An electrical connector according to claim 4, wherein said second shell portion defines a portion of said flange and further comprises a continuous wall portion depending therefrom in a direction opposite said upper surface and defining a configuration generally in a form of a D-shape and surrounding said contacts.

6. An electrical connector according to claim 5, wherein said joining means comprises a plurality of deformable tabs on one of said first or second shell portions and in deformed engagement with the other of said first or second shell portions whereby said first and second shell portions are held fixedly together.

* * * * *